United States Patent [19]

Nobel et al.

[11] 4,247,372

[45] Jan. 27, 1981

[54] SILVER PLATING

[75] Inventors: Fred I. Nobel, Sands Point; William Brasch, Commack, both of N.Y.

[73] Assignee: LeaRonal, Inc., Freeport, N.Y.

[21] Appl. No.: 937,849

[22] Filed: Aug. 29, 1978

[51] Int. Cl.[3] ..... C25D 3/46; C25D 5/02; C25D 5/08

[52] U.S. Cl. ..... 204/15; 204/46 R

[58] Field of Search ..... 204/46 R, 43 R, 109, 204/123, 15; 106/1.19

[56] References Cited

U.S. PATENT DOCUMENTS

| | | | |
|---|---|---|---|
| 1,857,507 | 5/1932 | Hickman et al. | 204/46 R |
| 2,113,517 | 4/1938 | Powell et al. | 204/46 R |
| 2,429,970 | 10/1947 | Wernlund et al. | 204/46 R |
| 2,666,738 | 1/1954 | Kardos | 204/46 R |
| 3,238,112 | 3/1966 | Haslam | 204/46 R X |

FOREIGN PATENT DOCUMENTS

| | | |
|---|---|---|
| 848891 | 9/1952 | Fed. Rep. of Germany . |
| 2450937 | 5/1976 | Fed. Rep. of Germany . |
| 807172 | 1/1959 | United Kingdom . |

OTHER PUBLICATIONS

Malathy Pushpavanam et al., Electroplating & Metal Finishing, pp. 3–13, Jun. 1976.

*Primary Examiner*—G. L. Kaplan
*Attorney, Agent, or Firm*—Pennie & Edmonds

[57] ABSTRACT

The invention relates to silver plating utilizing low cyanide or non-cyanide silver plating baths by treating the substrate to be plated with a mercaptan and to low cyanide or non-cyanide baths containing a bath soluble mercaptan in a sufficient amount to eliminate or effectively reduce immersion plating of the silver onto the substrate.

7 Claims, No Drawings

SILVER PLATING

BACKGROUND OF THE INVENTION AND PRIOR ART

Electrodeposition of silver and its alloys has been practiced for many years, particularly in the decorative fields. The electrodeposition of silver has also been fairly widely used in the electrical and electronics industries, in addition to the electrodeposition of gold and as a replacement for gold.

One of the main problems involved in the electrodeposition of silver is that most metal substrates desired to be plated with silver will become plated with silver by immersion. This silver immersion plating occurs when no potential at all is being applied. This immersion plate is poorly adhered to the substrate resulting in poorly adhered electrodeposits. Thus, in electroplating silver it is common practice to first deposit a very thin layer of silver onto the substrate by what is known as silver strike. These silver strike solutions generally have low silver content and a high free cyanide content. With such solutions containing low silver and high free cyanide content, immersion plating of the substrate, such as a copper substrate, is sufficiently minimized or sufficiently adhered to the substrate to permit silver deposits to be electroplated thereon as adequately adherent deposits. The substrate having the thin strike layer of silver deposited thereon can then be electroplated using a conventional silver electroplating bath containing a higher silver content. Since silver will not immersion plate onto silver, a second and thicker coating of silver can be applied to the strike layer with satisfactory or good adhesion.

The problem of silver immersion taking place on substrates is even more pronounced when attempting to electroplate silver with the spot-plating process or when utilizing high-speed silver plating baths. Although the selective plating machines presently in use differ in many mechanical aspects, the silver plating cells found therein are essentially similar in operation in the respect that the plating solution is sprayed out at high velocity from jets or nozzles or similar type orifices against the plating surface. This results in a vigorous agitation in the confined cathode space, as is normally desired, and results in the high-speed plating of pure silver onto a limited plating area. In this process it is not only necessary to utilize a silver strike solution prior to the final electrodeposition of silver, but a further problem is encountered in that the silver immersion deposit takes place onto the metal base substrate strip during the off cycle of the spot-plating process. For example, in utilizing a device such as disclosed in the Johnson et al. U.S. Pat. No. 3,723,283, a spot silver strike would be applied at station S9 and the silver electroplated at station S11. At station S11 (see FIG. 4) the electrolyte is continuously pumped to the header. When the header is in the "on" position, the strip 10 is appropriately masked, the current is on by contact with the electrode, and the unmasked portions of the strip are electroplated. When the strip 10 is moved to electroplate the next area, the header is released, unmasking the entire strip, and the current is off. The electrolyte, however, is still being splashed onto the strip and causes silver immersion over the entire unmasked strip. Such silver immersion deposit not only interferes with the electrical properties desired, but it obviously results in a loss of a valuable metal.

Generally, silver cyanide electroplating baths, even when the substrate has been previously strike plated, deposit a dull, non-lustrous white layer of silver on the substrate requiring buffing to secure a bright deposit. This problem has been overcome to a significant extent in the prior art by adding brightening agents to the silver cyanide plating baths. Many brightening agents have been proposed for these baths including tellurium, selenium and sulfur compounds. The sulfur compounds are the ones that are predominantly used commercially today. Thus, the addition of the sulfur compounds to the conventional silver cyanide baths containing a high content of free cyanide act as brightening agents and generally result in the deposition of a highly lustrous, silver deposit needing little or no buffing.

These baths to which the sulfur compounds have been added, however, still deposit silver by immersion onto the metal substrate and therefore silver strike baths are still necessary to insure adequate adhesion of the electroplated silver. Examples of conventional silver baths and sulfur compound brightening agents are set forth in U.S. Pat. Nos. 2,110,792; 2,113,517; 2,800,439; 3,362,895; 3,446,716; and 3,580,821, as well as in an article entitled ELECTRODEPOSITED SILVER AND ITS ALLOYS, ELECTROPLATING AND METAL FINISHING, pp. 3–5 and 8–13 (June, 1976).

High-speed silver electroplating baths of the cyanide type containing little if any free cyanide, also have the disadvantage of silver immersion plating on the substrate and thus a silver strike is still preferred to secure the desired adhesion of the final silver deposit.

Although many non-cyanide silver plating baths are known and have been suggested for use in low-speed as well as high-speed plating, none of these have reached the stage of commercial significance. A thiosulfate silver plating bath is one example, but its use has been limited since it also requires a silver strike from a different type of bath, namely with a silver cyanide bath high in free cyanide and low in silver content. Attempts to use a thiosulfate strike bath, high in free thiosulfate and low in silver content, have not been successful since these baths also deposit silver by immersion and therefore interfere with the silver adhesion deposited by the main silver thiosulfate baths.

SUMMARY OF THE INVENTION

This invention relates to non-cyanide or low cyanide silver plating baths containing a silver compound or complex capable of being electroplated and a bath soluble compound containing a mercapto group in sufficient amount to prevent or significantly deter silver deposition by immersion. The invention includes treating or coating the substate to be plated with a compound containing a mercapto group and subsequently electroplating the treated substrate with a silver electroplating bath which may or may not contain a bath soluble compound containing a mercapto group.

As previously discussed, bath soluble sulfur compounds, including mercaptans, have been previously used as brightening agents in silver cyanide baths containing a high cyanide content. The addition of these soluble sulfur compounds to the silver cyanide baths, containing a high content of free cyanide, do not prevent silver immersion deposition on the metal substrate when the substrate is immersed into the bath.

High-speed as well as low-speed baths have also been disclosed that do not contain a high free cyanide content. Examples of such baths are disclosed in the U.S. Pat. No. 4,024,031 to Lerner. These baths, such as disclosed in the Lerner patent, also deposit silver by immersion onto the metal substrate again interfering with the adhesion of the silver electroplating deposit.

The applicants have discovered that treatment of the substrate with a mercaptan prior to silver electroplating or the addition of bath soluble mercaptans to certain non-cyanide baths and to cyanide baths having a limited amount of free cyanide, such as those disclosed in the Lerner patent, prevent or significantly deter silver immersion deposition on the substrate. The effect of the mercaptan compounds in these baths in retarding the immersion deposits of silver is so pronounced that electroplated silver deposits can be obtained directly on the substrate without the use of silver strike plating, and with good adhesion.

The addition of these mercaptan compounds to the conventional high free cyanide silver baths produces a brightening effect as disclosed in the prior art, but they do not inhibit or retard silver immersion deposition. The addition of these same mercaptan compounds to certain non-cyanide silver baths or low cyanide silver baths, according to this invention, eliminate or significantly inhibit silver immersion, but do not have the brightening effect as in the prior art baths.

This invention also includes silver non-cyanide strike baths such as silver-thiosulfate, or thiocyanate strike baths containing a sufficient amount of a mercaptan compound to prevent or significantly deter silver immersion deposition on the metal substrate. Silver-thiosulfate complex strike baths having a low silver content are known, but these baths cause silver to deposit by immersion onto the metal substrate thereby interfering with the adhesion of the final conventional silver electroplating. In order to utilize silver-thiosulfate complex electroplating baths, it had heretofore been necessary to use a low silver, high cyanide strike bath in order to obtain sufficient adherence of the silver deposit using conventional heavy silver thiosulfate baths. The addition of the mercaptans to the silver-thiosulfate strike baths prevents or significantly retards silver immersion deposition onto conductive substrates and permits the electrodeposition of silver to a metal substrate by a process completely free of cyanide thus eliminating all hazards associated with silver cyanide plating or strike baths.

DESCRIPTION OF THE INVENTION

The silver plating baths of this invention can contain various silver compounds or complexes capable of being electroplated, such as those described in the prior art. The preferred silver compounds are alkali silver cyanide, e.g., $KA_g(CN)_2$. The amount of silver present in the baths can be that which is conventionally used in both low-speed and high-speed baths. Generally a higher silver content is preferred for high-speed baths especially when high ASF is being used. For example in high-speed baths using an ASF of between 800 to 1000, it is desirable to use about 60 g/1 of silver metal.

The temperature of the baths can varied widely. They can be operated at room temperature, but it is preferred to operate high speed baths at about 100° to 150° F.

The pH of these high speed plating baths can be those which are normally used in the art. A pH of 8 to 9.5 is preferred. Lower pH's can be used, but baths containing high concentrations of silver are not as stable at the lower pH's. Higher pH's can also be used, but as the pH is increased above about 9.5 free cyanide builds up in the bath which presents some control problem. Best results according to this invention can be obtained with copper and copper alloy substrates.

Examples of bath soluble mercaptan compounds that can be used according to this invention include mercapto derivatives of polyglycols and organic acids such as thioglycerol, thiomalic acid and thiolactic acid.

The concentrations of these mercaptan compounds in the silver baths necessary to prevent or significantly retard silver immersion deposition on the substrate depend to some extent on the particular bath being used and the particular mercaptan compound employed, all of which can be determined by routine experimentation. In the basic bath, as set forth in Example 1, for example, thioglycerol is effective at about 0.25 ml/l, thiomalic acid at about 0.6 g/l and thiolactic acid at about 0.15 ml/l. Higher concentrations could, of course, be used so long as the mercaptan compounds remain soluble in the baths, but since the lower concentrations are quite effective, there appears to be no need or advantage in using higher concentrations. Based on experiments to date, thiolactic acid is the preferred compound.

The free cyanide content permissable according to this invention together with the mercaptan compounds which prevent or retard silver immersion plating will depend somewhat upon the basic silver bath employed as well as on the particular mercaptan compound being used and the amounts thereof. Best results to date have been obtained utilizing silver plating baths containing minimal or no free cyanide and by operating the baths at a pH which permits evolution of free cyanide from the bath as it is produced in situ due to removal of the silver metal. The amount of free cyanide tolerable can be determined by routine experimentation with any particular system and experiments to date, using the basic bath as described in Example 1 and 0.15 ml of thiolactic acid, indicate that the free cynaide should be maintained below about 10 g/l to insure substantial freedom from silver immersion to the extent that it will interfere with adhesion.

The main intended use of these deposits is in the semiconductor field, which involves die attaching and bonding. For this purpose it is not necessary for the deposit to be bright.

Although the silver deposits and plating baths produced according to this invention are acceptable without change, the invention includes the addition to the baths of a selenium compound which improves the smoothness of the deposit and the ability to plate at higher current densities.

As previously discussed, selenium compounds are known brightening agents for conventional high cyanide silver plating baths. See U.S. Pat. No. 2,110,792 for example. Their use in the baths of this invention is not considered to be obvious, however, since the brightening effect is not very great and in view of the fact that the other known brightening agents used in conventional high cyanide silver baths, such as the mercaptan compounds, do not produce the brightening effect that would be expected.

Other components can be added to the baths according to this invention, such as surface active agents, conductive agents, buffers such as borates, citrates, alkali monobasic phosphates, alkali dibasic phosphates, etc., as will be apparent to those skilled in the art.

The fact that the silver strike can be eliminated and still obtain good adhesion of the deposit, and that substantially no silver is deposited by immersion on the substrate where it is not wanted, makes the baths of this invention highly desirable for commercial operations in the high-speed plating field for semi-conductor manufacture.

The invention also includes the addition of mercaptan compounds to non-cyanide silver strike baths to prevent silver immersion plating. Examples of such baths include the alkali silver thiosulfate complex strike baths. These strike baths generally contain less than about 5 g/l of silver metal, free alkali thiosulfate and a conductive agent such as an alkali citrate.

The use of the mercaptans in standard thiosulfate silver baths containing higher amounts of silver metal and free alkali thiosulfate do not prevent silver deposition by immersion. For example, the addition of 0.15 ml/l of thiolactic acid to a bath containing about 30 g/l of silver metal as a sodium thiosulfate silver complex, about 250 g/l of free sodium thiosulfate and about 20 g/l of sodium sulfite $Na_2S_2O_3$ does not prevent silver immersion deposition. Thus according to this aspect of the invention, the use of a silver thiosulfate strike bath is still required for commercial operation. The substrate, such as copper, is first strike plated with a silver thiosulfate strike bath containing a mercaptan, and since there is no immersion plating, the silver strike adheres well to the substrate permitting a subsequent application of a conventional thicker silver electrodeposit by a standard silver thiosulfate bath, such as described above. Although this aspect of the invention does not eliminate a strike bath, it does serve a very important purpose in eliminating the necessity of using a silver cyanide strike bath to obtain a silver strike deposit of sufficient adherence to the substrate.

Silver immersion depositions can also be prevented in the non-cyanide silver bath such as the silver thiosulfate strike baths and the silver cyanide baths containing about 10 g/l or less of free cyanide by first treating the substrate to be plated with a mercaptan compound. The substrate can be immersed or dipped into a mercaptan solution, for a few seconds and then either strike plated with a silver thiosulfate strike bath or directly silver plated with a silver cyanide bath of low free cyanide content. The mercaptan solution can contain anywhere from 0.05 percent mercaptan or above. The immersed substrate should not be permitted to film or tarnish. Thus, the amount of mercaptan and the time of immersion should be correlated to prevent filming or tarnishing of the substrate. The mercaptan solution can also contain high amounts of silver, such as 60 g/l, and 90 g/l of dipotassium phosphate. The substrate can then be plated in a silver bath absent any mercaptan.

Silver strike baths, whether they be of the cyanide or non-cyanide type, generally have a silver metal content of less than aboutn 5 g/l while the conventional plating baths or heavy silver plating baths generally contain at least about 15 g/l of silver metal. Thus, according to this invention, silver strike baths or low silver baths are those containing less than about 5 g/l of silver metal and silver plating baths contain at least about 15 g/l of silver metal.

EXAMPLE 1

An aqueous basic silver plating bath containing 90 g/l of dipotassium phosphate, 60 g/l of silver metal as soluble alkali silver cyanide was prepared. To this basic bath 0.15 ml/l of thiolactic acid was added and silver plated therefrom in a conventional high-speed, spot, or jet plating process on a copper substrate at a temperature of about 140° F. and at an ASF of about 800. The silver deposits obtained were not bright but their properties, such as adhesion to the substrate, were excellent for their intended electrical use. No deposition of silver by immersion was observed. When the basic bath alone was used to plate silver, very significant deposition of silver by immersion was observed.

EXAMPLE 2

Example 1 was repeated with the addition of 1 ppm of KCNSe together with the thiolactic acid. The same results were obtained as in Example 1 and a smoother deposit was obtained.

EXAMPLES 3 and 4

Two separate basic baths as described in Example 1 were prepared. To one bath 0.25 ml/l of thioglycol were added and to the other 0.6 g/l of thiomalic acid was added. Both baths were used to plate silver in the same manner as set forth in Example 1 and substantially the same results obtained.

EXAMPLES 5 and 6

To each bath of Examples 3 and 4, lppm of KCNSe was added in addition to the mercaptans and silver plated as described in Example 1. Substantially the same results were obtained as set forth in Examples 3 and 4, but the deposits were smoother and somewhat brighter.

EXAMPLE 7

An aquious silver thiosulfate strike solution was prepared by mixing with water, 30 g/l of sodium thiosulfate, 30 g/l of sodium citrate and 1 g/l of silver metal as a sodium thiosulfate complex. Silver deposition by immersion took place on a copper substrate when using this strike bath, resulting in poor adhesion. 0.15 ml/l of thiolactic was then added to the bath. Silver deposition by immersion did not take place and adhesion was excellent.

EXAMPLE 8

A 0.05 percent by weight aqueous solution of thiolactic acid was prepared and cleaned copper substrates immersed therein for a few seconds. The thus treated substrates were then strike plated with the silver thiosulfate solution of Example 7 before addition of the thiolactic acid thereto. No silver immersion deposits were noted and the adhesion of the silver strike plating was excellent. Similarly treated copper substrates were also silver plated with the basic silver cyanide bath of Example 1. No immersion deposition of silver was noted and the adhesion of the silver plating to the substrate was excellent.

We claim:

1. Process for the electrodeposition of silver on a copper or copper alloy substrate comprising electroplating such substrate with an alkali silver cyanide electroplating bath containing about 10 g/l of free cyanide or less and a mercaptan compound in sufficient amount to eliminate or retard silver immersion deposition on such substrate, and maintaining the free cyanide content below that which will cause immersion plating in the presence of the mercaptan compound.

2. The process of claim 1 in which the mercaptan is a mercapto derivative of a polyglycol or an organic acid.

3. The process of claim 2 in which the mercaptan is thiomalic acid, thiogycol or thiolactic acid.

4. The process of claims 1, 2, or 3 in which the electrolyte solution contains an alkali phosphate.

5. The process of claim 4 in which the substrate is copper.

6. The process of claim 1 in which the silver metal is about 60 g/l.

7. A process for the electrodeposition of silver utilizing the high-speed or selective plating process which comprises continuously spraying an alkali silver cyanide plating bath at high velocity against a plating surface in which the plating bath comprises at least about 15 g/l of silver as an alkali silver cyanide, 10 g/l of free cyanide or less, and a mercaptan compound in sufficient amount to eliminate or retard silver immersion deposition on the surface, and maintaining the free cyanide content below that which will cause immersion plating in the presence of the mercaptan compound.

* * * * *